United States Patent [19]

Gerritsen

[11] Patent Number: 4,575,966

[45] Date of Patent: Mar. 18, 1986

[54] MAGNETICALLY SEALED SLIDING WINDOW ASSEMBLY

[75] Inventor: John T. Gerritsen, Hanover Park, Ill.

[73] Assignee: Jarrow Products, Inc., Chicago, Ill.

[21] Appl. No.: 644,933

[22] Filed: Aug. 27, 1984

[51] Int. Cl.[4] ..... E05D 15/10

[52] U.S. Cl. ..... 49/209; 49/404; 49/234; 49/378

[58] Field of Search ..... 49/209, 234, 127, 378, 49/404, 409, 410, 413

[56] References Cited

U.S. PATENT DOCUMENTS

| | | | |
|---|---|---|---|
| 3,334,442 | 8/1967 | Boettcher | 49/410 X |
| 3,346,993 | 10/1967 | Johnson | 49/409 |
| 3,465,536 | 9/1969 | Vogel et al. | 49/478 X |
| 3,947,998 | 4/1976 | Matsubara | 49/209 |
| 4,114,317 | 9/1978 | Crawley | 49/209 |

*Primary Examiner*—Kenneth Downey

*Attorney, Agent, or Firm*—Silverman, Cass & Singer

[57] ABSTRACT

A magnetically sealed sliding window system including a perimetric frame including header and base portions each defining a narrow channel for receiving a glazing pane and an adjacent second channel. A sliding panel is seated within the second channel. Longitudinal magnets are secured on the inner face of the sliding panel. Where the perimetric frame is formed of nonmagnetic material, magnets also are secured along the header and base second channel sections. No magnets are required on the perimetric frame when same is formed of magnetic material such as steel. In sealed condition, the sliding panel is positioned above the floor of the base channel with the panel magnetically held. The magnets have longitudinally extending magnetic poles establishing a magnetic coupling between adjacent unlike poles. The height of the sliding panel is less than the height of the frame. Translation of the sliding panel first in a vertical direction, shifts the adjacent magnetic polarity so that repulsion force causes the sliding panel to be displaced into an offset vertical plane, disengaging the magnets dropping the sliding panel into the base channel and freeing same for translation in a horizontal direction. Release of the panel results in reestablishment of the magnetic coupling. A purchase is provided on the outer face of the sliding panel of facilitate translation of the panel. Ramps are provided when the frame is formed of magnetic material to displace the sliding panel into the offset vertical plane when the panel is vertically translated to dislodge the sliding panel from the magnetic coupling. A strip of ferrous material may be applied to the perimetric frame header and base sections if same are formed of nonmagnetic material.

14 Claims, 7 Drawing Figures

MAGNETICALLY SEALED SLIDING WINDOW ASSEMBLY

BACKGROUND OF THE INVENTION

This invention relates generally to magnetically sealed sliding window systems and more particularly, provides a magnetically sealed sliding window assembly including at least one sliding panel magnetically sealed in stationary condition but capable of being released to face same for translation in a horizontal direction by shifting the magnetic polar relationship and/or the vertical plane occupied by the panel.

Sliding windows both for use in prime window constructions or as auxiliary indoor window installations, i.e. storm windows, have achieved widespread popularity and would likely be more popular if their cost were reduced and the ease of manipulation were improved. Installations of the type concerned include a perimetric outer frame having a track for accommodating a slidable glazing panel. The outer frame also may include channels capable of receiving a glazing panel which can be stationary, i.e. fixed.

Both or either of the perimetric frame and the frame holding the glazing member of the panel may be formed as a profile of extruded plastic material or of metal sections which include beveled ends which can be secured abutted to form the particular frame for the perimetric frame and/or the sliding panel.

Although prior installations have often featured magnetic sealing means, exposure of the installation to the elements, heat, cold, rain and wind, have resulted in distortion, buckling, undesired expansion or shrinkage (contraction) resulting in difficulty in retention of the glazing panels, warping, possible fracture of the glazing panels and/or interference with the smooth manipulation of the panels. Often complex magnetic structures increase costs. Complex purchase means for grasping the sliding window panel for breaking the seal have been required. Also, increasing cost and complexity not conducive to facile operation and inexpensive manufacture and installation are common.

It would be highly desirable to provide magnetically sealed installations with means which facilitate operation without sacrificing the sealing effectiveness when opening and/or closing is not desired. Manipulation of the assembly should be facilitated for opening and closing with retention of sealing effectiveness against wind, rain, hail, etc. Where the installation is indoors, esthetics and appearance also is a factor. Economy in manufacture and installation likewise is an important consideration. Achievement of these functional, economic and esthetic factors has not been realized with the structures presently available to the art.

Another goal to be achieved is the provision of an indoor installation which also is capable of prime usage such as for patio doors, for example. Further, use of the same type of system for other purposes such as for doors for display cabinets or commercial freezer doors used in retail establishments, display cabinets of general usage and the like.

Accordingly, the system of this herein invention is intended to meet the above needs and overcome the disadvantages generally found in prior available systems of this type.

SUMMARY OF THE INVENTION

The invention provides a magnetically sealed sliding window system including at least one sliding panel and a perimetric frame including channel means for receiving same. Longitudinally poled magnets are provided so that the sliding panel can be opened and closed in sole reliance on the repulsion/attraction forces of the magnetic fields. In the sealed condition, the magnets are aligned longitudinally with dissimilar poles providing an attractive force sufficient to establish a tight seal.

The sliding panel is dislodged from said closed condition first to shift the polar relationship and/or to shift the panel from its magnetic coupling to a disposition vertically offset. In the former instance a repulsion force is effected pushing the panel to the displaced offset condition. The sliding panel falls under gravitational force to bottom within the base channel of the frame. The slidable panel then is free to be translated in the channel or track. Resealing is effected by lifting or raising the sliding panel to reestablish the like polar alignment.

One embodiment includes a magnet to magnet relationship, magnets provided on both frame and panel while another embodiment for use with ferrous metal frames or strips employs a magnet on the panel and a wedgelike ramp formation formed on or secured to the frame or adjacent the strip to force the magnet bearing panel mechanically from the ferrous metal member to a condition offset therefrom again enabling sliding movement of said panel. Release of the panel enables the same to return to magnetically sealed condition.

BRIEF DESCRIPTION OF THE DRAWINGS

FIG. 8 is an enlarged sectional detail of the embodiment of FIG. 7 shown in slidable condition.

DESCRIPTION OF PREFERRED EMBODIMENTS

Figure 1:
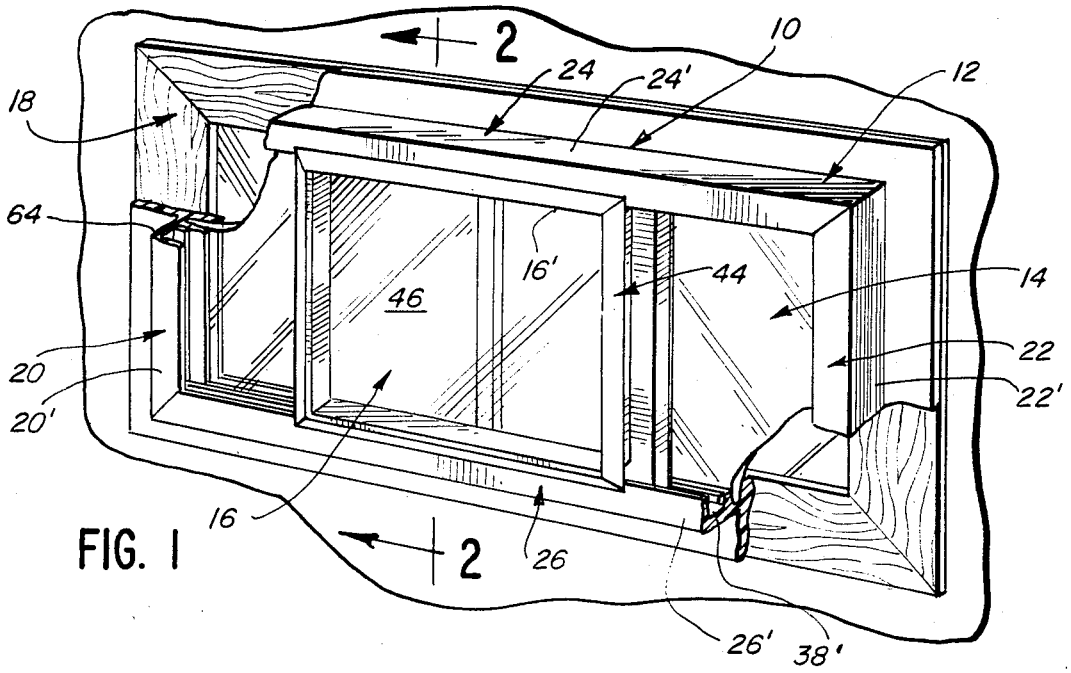
FIG. 1 is a front perspective view of the sliding window system constructed in accordance with the invention, a portion being broken away to show detail.
Figure 2:
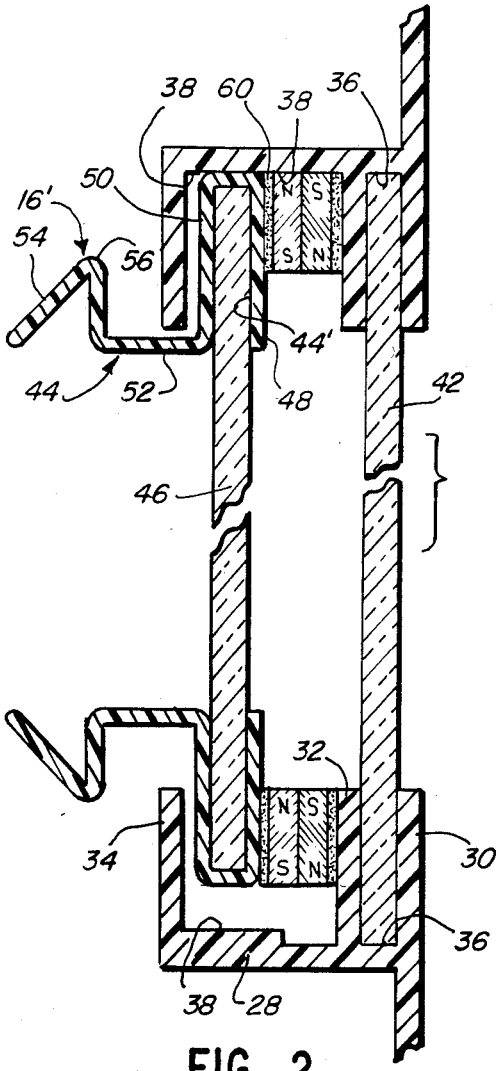
FIG. 2 is an enlarged fragmentary sectional view taken along lines 2—2 of FIG. 1 viewed in the direction indicated.
Figure 3:
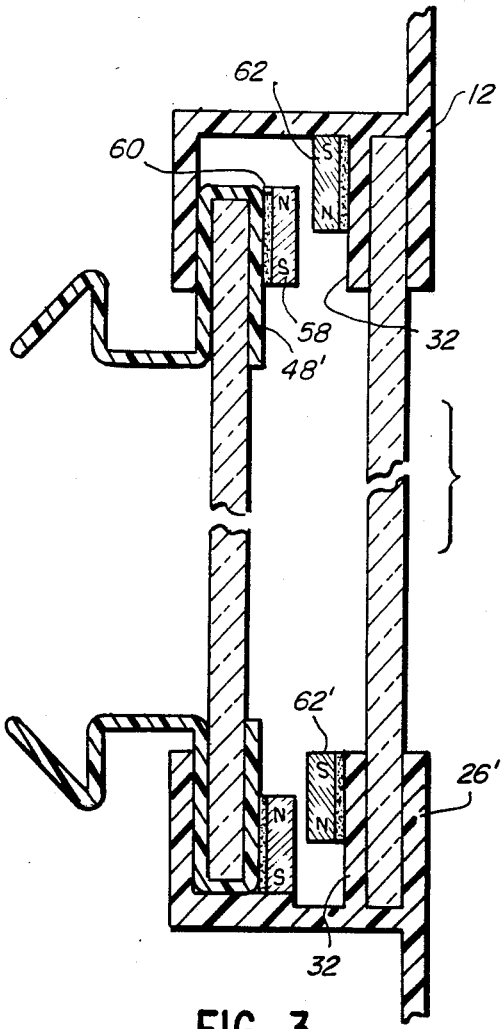
FIG. 3 is an enlarged sectional view taken similar to FIG. 2 but showing the slidable panel system in condition for slidable movement.

Briefly, the herein invention will be described as embodied in a magnetically sealed sliding storm window installation having magnet means capable of being selectively dislodged to break the seal and permit to translation at least one panel of the installation in a horizontal direction along a vertical plane, the seal being reengageable at any selected location. Movement between the sealed condition and the freely slidable condition employs magnetic attraction/repulsion forces by shifting of the polar alignment of the magnetic sealing means provided. Mechanical means to augment dislodgment is employed in a modified embodiment of the invention.

Referring now to the drawing, a magnetically sealed, secondary sliding window installation is illustrated and designated by reference character 10. The installation 10 comprises a perimetric frame 12, a stationary panel 14 and a slidable panel 16. The illustrated sliding window is shown as installed over a prime window installation represented generally by reference character 18. The perimetric frame 12 includes sides 20,22, header 24 and base 26 and is formed of equal length side sections 20',22' and equal length header and base sections 24',26'. Each of said sections 20', 22', 24' and 26' includes a floor portion 28,28' and upright perpendicular wall portions 30,32 and 34. Walls 30,32 are parallel and coextensive with the respective section defining, with the floor 28,28', a relatively narrow glazing channel 36. Walls 32,34 with the floor 28,28' define a track or channel 38,38'.

Channel 36 is adapted frictionally, tightly, to receive panels 40,42 preferably formed of glass or transparent rigid sheet plastic material. Channel 38 is substantially wider than channel 36 and functions as a track to guide the translation of sliding panel 16 therein. The opposite ends of each frame section are beveled to facilitate forming of miter joints in assembling the sections 20', 22', 24' and 26' to define the perimetric frame 12 with all the aforementioned channels 36 and 38 opening inward of the frame 12, opposite channels being aligned.

The respective frame sections preferably are formed of rigid lengths of extruded plastic material, such as, for example, polyvinyl chloride. Suitable flanges or the like can be formed simultaneously to facilitate adherence thereof to an underlying wall, sill or header of the prime installation 18 bordering such installation 10.

Panel 42 which is seated in channel 36' may be stationary. Channels 38,38' are intended to receive the sliding panel 16.

The sliding panel 16 comprises a channeled frame 44 into which a glazing pane 46 may be received. The frame 44 is formed by assembling with miter joints profile sections 16' to define a channel 44' employing closely spaced parallel upright walls 48 and 50. Spacer section 52 extends outward from wall 50 with return flange 54 formed as a portion of the profile 16' unitary with the outer edge 56 of spacer section 52. Profile 16' preferably is thin walled compared to the thickness of the perimetric frame so as to lessen the weight of the sliding panel. The height of the panel 16 preferably is less than the height of the frame so that the strength of the magnetic field along the header and base is greater than the strength of the magnetic field along the sides of frame 12 whereby release of the field along the header and base overcomes the magnetic field along the sides.

Flange 54 extends inward toward the pane 46 and affords a purchase or pull by which the panel 16 is translated in a vertical direction to disengage the magnetic coupling. The width of the profile 16' is selected to enable free movement sliding translation of said panel 16 within the channel 38,38' once the magnetic coupling is disengaged and the panel 16 drops into the channels 38,38' of the perimetric frame 12. The longer dimension of the panel 16 is selected to be less than the length of sides 20, 22 of the frame 12 so as to enable limited movement of translation of the sliding panel 16 in a vertical direction whereupon the panel is shifted or displaced to a vertical plane offset from its vertical plane occupied thereby in its magnetically sealed condition. The outer surfaces 48' of walls 48 define a portion of the inner face of the sliding panel 16 and carry longitudinal bar magnets 58 having longitudinal poles. The magnets 58 are secured to said surfaces 48' by suitable adhesive such as double faced magnetic tape 60. Similar bar magnets 62 and 62' are applied to the outer surface of walls 32 along channels 38 and 38', these magnets also having longitudinal magnetic poles, magnet 62 located coextensive with the header section 24' with magnet 62' being coextensive with the base section, magnet 62 having an edge engaged with the floor 28 while the magnet 62' has an edge flush with the free edge of the wall 32 of the base section. Magnets 58, 62 and 62' all are bar magnets and magnets 62 and 62' are oriented with their magnetic poles reversed compared to the magnetic poles of magnets 58 secured to the slidable panel 16. Magnets 64, identical to magnets 58, 62 and 62' are secured in like manner to the walls 32 carried by the side sections 20',22' and defining the channels 38,38' carried thereby. When the panel 16 is introduced into the channels 38,38' with the magnets 58 secured on the inner face of said panel 16, the panel 16 raised above the floor 28,28' of said channels 38,38' and the panel 16 disposed at the left hand side of the installation 10, a magnetic seal is established. The strength of the established magnetic fields are selected so that when the panel 16 is shifted vertically, the like poles of the magnets 62 and 62' are aligned with the like poles of magnets 58. The force of magnetic repulsion overcomes the forces of attraction along the side of the panel 16 (and the appropriate magnets 64) to force the panel 16 to assume a disposition vertically offset from its magnetically sealed position. The panel 16 then drops, under gravitational force, into the channel 38,38'. The flange 54 can then be manipulated to translate the panel 16 in a horizontal direction following the channel 38,38'. When the panel 16 has been translated to establish a sufficient opening, the panel 16 is raised by grasping the flange 54 and manually lifting same, or simply released to reestablish the magnetic coupling along the header and base sections.

Figure 4:
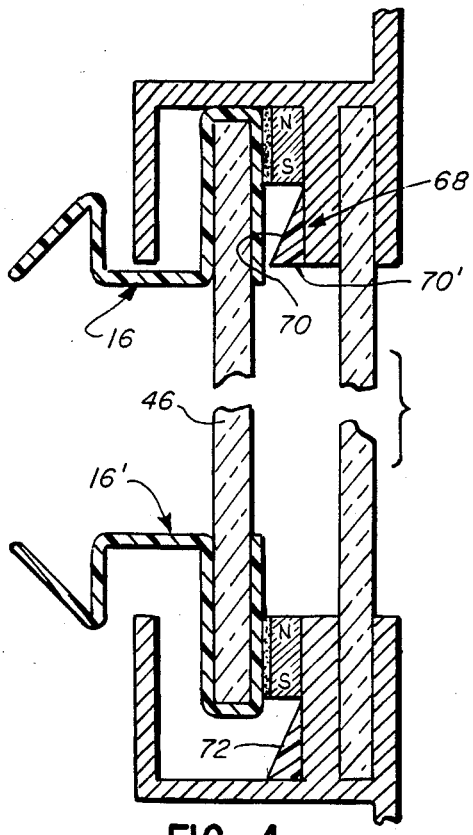
FIG. 4 is an enlarged fragmentary sectional view similar to FIG. 2 but illustrating a modified embodiment of the invention.
Figure 5:
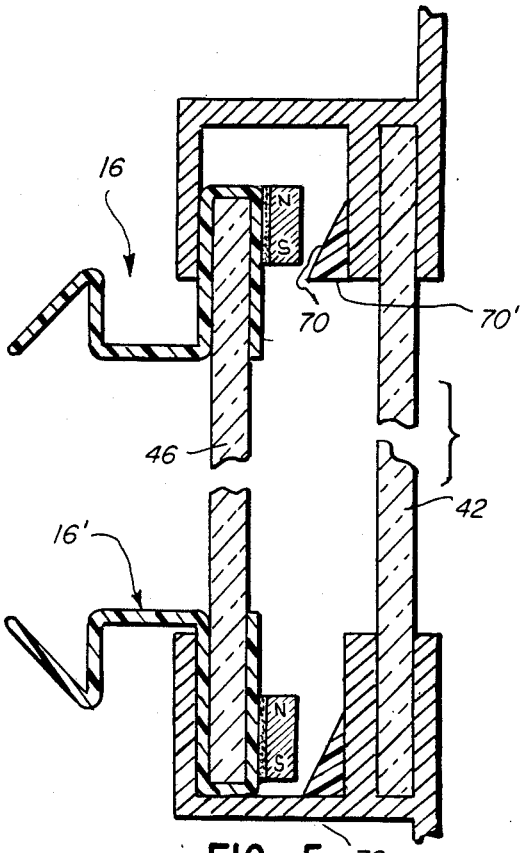
FIG. 5 is an enlarged fragmentary sectional detail of the modified embodiment of FIG. 4.
Figure 6:
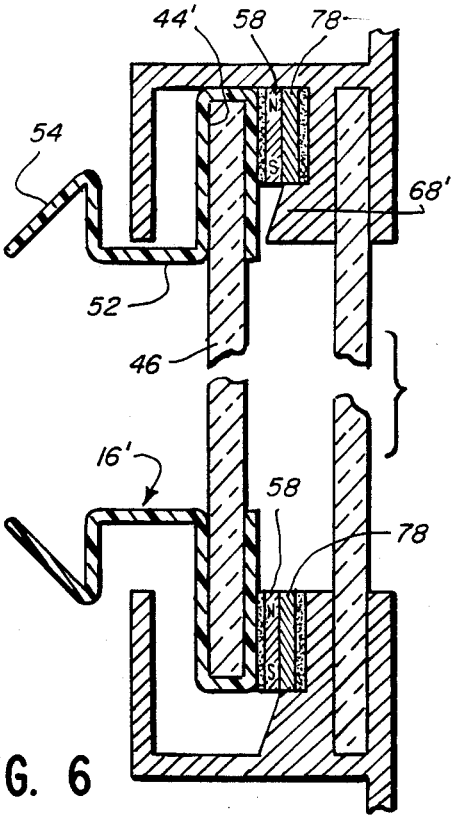
FIG. 6 is an enlarged fragmentary sectional detail of the modified embodiment of FIG. 4 with the panel in slidable condition.
Figure 7:
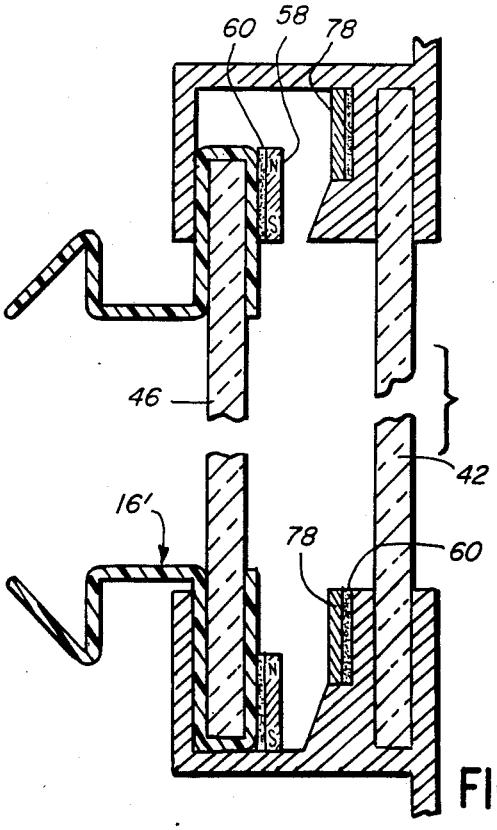
FIG. 7 is an enlarged fragmentary sectional detail of a still further modified embodiment of the invention.

Referring to FIGS. 4 to 7, there are illustrated modified embodiments of the invention particularly suitable for employment in installations where the perimetric frame 12' is formed of ferrous metal such as steel or a ferrous metal strip 78 is adhered to the appropriate wall of the frame 12, say when said frame is formed of aluminun, a nonmagnetic extrudable material. The perimetric frame cross-section is the same as that of frame 12. Magnets 62 are not installed onto the wall 32 thereof of the header nor is magnet 62' adhered to wall 32 of the base. However, a ramp or wedge member 68 is part of or secured to said wall 32. The end 70' of wedge or ramp member 68 is flush with the free edge of wall 32 along the header section of the frame so that the diagonal ramp is inclined toward wall 34 thereof. Wedge or ramp 62 is installed along the base section 26 so that the ramp 76 thereof diagonally is directed toward the floor 28,28'. Exercise of force upon the purchase flange formation 54 causes the magnets on panel 16 to move along the ramps 70,76 to a location offset from the frame and located so as to be unaffected by the magnetic fields, thus overcoming the magnet field effect and enabling free sliding movement of the panel 16 within the channel 38,38'.

Thus there has been described a sliding window system comprised of three distinct extruded (preferably polyvinyl chloride) profiles and one configuration of extruded elongate longitudinally 2-poled magnet. Opening and closing action is dependent upon the repulsion-/attraction principle of the magnets, i.e. like poles repel, unlike poles attract. In closed condition, the magnets on the movable panel are aligned with those in the frame in such that the dissimilar poles align, providing an attractive force and in turn providing a very tight seal.

Forcing the panel vertically toward the bottom of the frame forces the poles on the top and bottom of the panel into alignment with like poles of the magnets situated in the frame. The alignment of like poles provides a repulsion force, pushing the panel away from the frame magnets. The repulsion takes place on the horizontal magnets only, since the vertical magnets still retain their relative pole arrangements. However, the repulsion force must be strong enough to break the attraction in the vertical magnets. Hence the width of the movable panel should be greater than its height, or if the vertical frame magnets may be omitted, weakening the attraction.

Once the vertical attraction is broken, the repulsive force of the horizontal magnets now facilitates ease of horizontal movement for the movable panel.

When the downward force on the movable panel is removed, the horizontal magnets will realign, therefore bringing the movable panel back to its stationary, magnetically sealed condition.

I claim:

1. A sliding window system comprising a perimetric frame including channel means and at least one double faced panel received within said channel means for sliding movement therein, cooperable longitudinally disposed magnetic means within said channel means and carried by said panel for establishing a sealed engagement therebetween on a static condition of the panel to immobilize said panel and being disengageable in a slidable condition of the panel offset vertically from the static condition to permit sliding movement of said panel, said magnetic means comprising elongate magnets poled longitudinally, means for adhering said magnets to said panel on one face thereof adjacent the edges thereof and pull means on the opposite face of said panel capable of being grasped for translating said panel in a first direction to disengage said magnets displacing said panel to the slidable condition, and thereafter to enable translation in a second direction to a selected location along the length of said channel means, said latter means being releasable to reestablish said sealed engagement at the selected location.

2. The system as claimed in claim 1 wherein said perimetric frame comprises end to end abutted sections assembled to define a generally rectangular frame having first and second channels, said first channel capable of receiving a glazing panel securely therein and said second channel adapted to receive said panel and including a flange and a floor, said magnets formed of a generally rectangular cross-section and second magnets each of a generally rectangular cross-section adhered to said flange, the second magnets applied with their longitudinal magnetic polarity inverted relative to the polarity of the first magnets.

3. The system as claimed in claim 2 wherein the frame is assembled to define a header section, a base section and side sections, one of said second magnets being adhered to said flange adjacent the floor of the second channel and along the header section, and a second magnet being adhered to said flange of said base section along the outer edge thereof spaced from the floor thereof, the magnetic poles of said second magnets being oriented identically along the header and base sections, said first and second magnets being in unlike polar alignment in the static condition of the panel and in like polar alignment in the slidable condition of the panel.

4. The system as claimed in claim 1 and means defining a formation secured on said flange interior of said channel and inclined relative thereto to direct said panel to the slidable condition outwardly extending from the flange subsequent to disengagement of said magnetic seal between the frame and said panel.

5. The system as claimed in claim 1 in which said perimetric frame is formed of nonferrous metal and a strip of ferrous metal is adhered to said flange located to effect a magnetic seal between the outer surface thereof and the magnet carried by said panel, movement of said panel downward in a vertical direction causing said frame to assume the slidable condition disposed vertically offset enabling slidable free movement of said panel in the channel.

6. The system as claimed in claim 1 in which said perimetric frame is formed of ferrous metal.

7. The system as claimed in claim 1 in which said magnets are secured to said flange along the side sections thereof whereby magnetically to couple to the magnets along the sides of the frame, the force of attraction along the sides being of insufficient strength to overcome the force of repulsion when the polar relationship is changed along the header and base sections.

8. The system as claimed in claim 1 in which said panel includes thin walled extruded profile framing sections having first and second channels defined therein, said profile sections assembled end to end and a pane member seated within the first channel, the second channel being wider than the first channel, the second channel including a floor and a flange terminating in a longitudinal flange extending toward the pane to define said pull means.

9. The system as claimed in claim 1 wherein said pull means comprise a flange on the frame spaced therefrom and having an inwardly directed angular flange coextensive therewith.

10. The system as claimed in claim 5 and an inclined ramp is applied to the perimetric frame, to intercept said panel causing said panel to assume the offset disposition thereof.

11. In a sliding panel assembly for use as a primary or secondary closure wherein there is a perimetric frame for receiving at least one sliding panel, the frame having channel means, at least one slidable panel being received within said channel means, cooperable magnet means for establishing a magnetic coupling between the frame and the panel in a static condition thereof and said coupling being released when the panel assumes a second slidable condition relative to said frame, means to effect displacement of said panel between said static and slidable conditions, the static condition establishing said magnetic coupling, the slidable condition occurring when said panel is displaced offset from the plane occupied during the static condition so that the panel is freed for slidable translation.

12. The assembly as claimed in claim 11 wherein said perimetric frame is formed of like cross-sectionally configured sections assembled end to end and including parallel spaced upstanding walls.

13. The assembly as claimed in claim 11 wherein said channel means comprise a first channel defined by a first pair of said walls and a second channel defined by one of said first pair of walls and a third wall, the first channel having a lesser width than the second channel and capable of accommodating a glazing panel fixedly therein, and the slidable panel including elongate framing profile sections accommodating a planar panel therein, said framing profile including a guide channel cooperative with said second channel and pull means on the said profile for selective raising and lowering of the assembled framed panel between said conditions.

14. The assembly as claimed in claim 11 in which said magnet means comprise elongate longitudinal magnet bodies of generally rectangular configuration having longitudinal magnetic poles extending longitudinally along the opposite elongate edges, the magnet bodies and means for securing said bodies in the second channels along the header and base sections of the frame and having like orientation of the magnetic poles and panel framing magnet bodies arranged oriented to place the framing magnet bodies in opposite polar relationship, said panel being capable of being raised and lowered to assume the static and slidable conditions respectively.

* * * * *

UNITED STATES PATENT AND TRADEMARK OFFICE

CERTIFICATE OF CORRECTION

PATENT NO. : 4,575,966

DATED : March 18, 1986

INVENTOR(S) : JOHN T. GERRITSEN

It is certified that error appears in the above-identified patent and that said Letters Patent are hereby corrected as shown below:

Column 2, lines 54 and 55 should be deleted.

Signed and Sealed this

Twenty-third Day of December, 1986

*Attest:*

DONALD J. QUIGG

*Attesting Officer* *Commissioner of Patents and Trademarks*